United States Patent [19]

Tiffany

[11] Patent Number: 4,563,037

[45] Date of Patent: Jan. 7, 1986

[54] CONVERTIBLE FURNITURE

[75] Inventor: H. Robert Tiffany, Philadelphia, Pa.

[73] Assignee: Tiffany & Tiffany, Philadelphia, Pa.

[21] Appl. No.: 548,752

[22] Filed: Nov. 4, 1983

[51] Int. Cl.[4] ..... A47C 13/00

[52] U.S. Cl. ..... 297/105; 5/42

[58] Field of Search ..... 297/105; 5/29, 35, 42

[56] References Cited

U.S. PATENT DOCUMENTS

| | | | |
|---|---|---|---|
| 239,664 | 4/1881 | Nash . | |
| 324,661 | 8/1885 | Crandall . | |
| 1,061,986 | 5/1913 | Coopersmith . | |
| 1,251,079 | 12/1917 | Mester . | |
| 1,263,509 | 4/1918 | Zendt . | |
| 1,320,365 | 10/1919 | Clough . | |
| 1,323,563 | 12/1919 | Wilson . | |
| 2,126,588 | 8/1938 | Thum . | |
| 2,216,317 | 10/1940 | Karish . | |
| 2,248,603 | 7/1941 | Bell | 297/105 |
| 2,577,741 | 12/1951 | Creveling et al. . | |
| 2,615,502 | 10/1952 | Schneider . | |
| 2,634,430 | 4/1953 | Rogers . | |
| 3,385,630 | 5/1968 | Greiner . | |
| 3,432,203 | 3/1969 | Cavalli . | |
| 3,600,034 | 8/1971 | Jones et al. . | |

FOREIGN PATENT DOCUMENTS

| | | | |
|---|---|---|---|
| 449460 | 9/1927 | Fed. Rep. of Germany . | |
| 2757167 | 12/1978 | Fed. Rep. of Germany . | |
| 264672 | 5/1929 | Italy . | |
| 38331 | 2/1915 | Norway . | |
| 134567 | 2/1952 | Sweden . | |
| 287989 | 4/1928 | United Kingdom | 297/105 |

*Primary Examiner*—Francis K. Zugel

*Attorney, Agent, or Firm*—Alexander, Unikel, Bloom, Zalewa & Tenenbaum, Ltd.

[57] ABSTRACT

A chair or couch is convertible into a bed by pivoting each of the seat portion and back portion about discrete horizontal axes extending between opposite sides of a frame.

6 Claims, 7 Drawing Figures

CONVERTIBLE FURNITURE

BACKGROUND

It is known to convert a chair or couch into a bed. See U.S. Pat. Nos. 2,634,430 and 3,600,034. The present invention is directed to the solution of the problem of how to structurally interrelate the components of convertible furniture in a manner so as to minimize the number of components, provide better support so that the furniture is more durable, and provide furniture which is easier to assemble while minimizing costs.

SUMMARY OF THE INVENTION

The present invention is directed to convertible furniture wherein a chair or couch can be converted into a bed. The chair or couch includes a frame supporting a seat portion and a back portion. Each of the seat and back portions is connected to opposite portions of the frame for pivotable movement about discrete horizontal axes between first and second positions. In the first position, the seat and back portions cooperate to form a chair or couch. In the second position, the seat and back portions are horizontally aligned to form a bed. The seat portion has two sections hinged to a leg which is between the seat portions which overly one another in the first position.

Various objects and advantages of the present invention will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
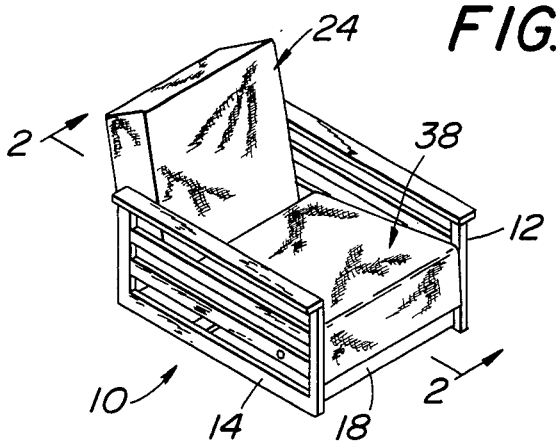
FIG. 1 is a perspective view of convertible furniture in accordance with the present invention.

Referring to the drawing in detail, wherein like numerals indicate like elements, there is shown in FIG. 1 convertible furniture in accordance with the present invention designated generally as 10. For purposes of illustration, the furniture is a chair but could be a couch or the like.

The furniture 10 has a frame comprised of oppositely disposed frame sides 12 and 14 connected by a frame back 16, a frame front 18 and one or more base braces 20. For ease of illustration, the frame is shown as exposed wood or plastic but preferably the frame is padded or cushioned. The frame sides can be preassembled as rectangular frame members having vertical and horizontally connected strips of wood. The wooden portions of the frame may then be covered with fabric or some other covering material such as plastic.

Figure 2:
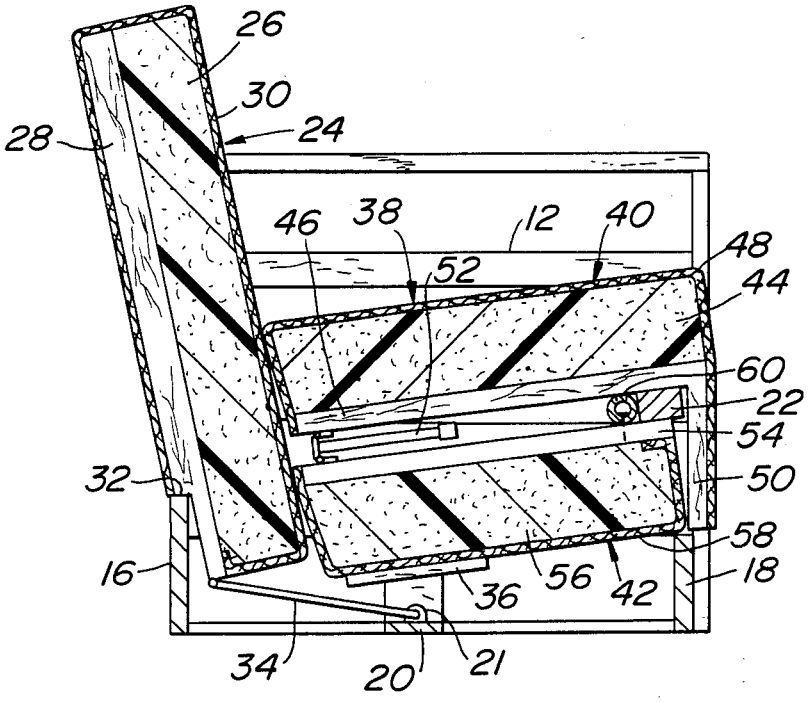
FIG. 2 is a sectional view taken along the line 2—2 in FIG. 1.

The furniture 10 includes a back section 24 which is upright but preferably slightly tilted as illustrated. The back section 24 includes a cushion 26 juxtaposed to a rigid substrate 28, each of which are covered by a covering 30 which may be fabric, plastic, or the like. Substrate 28 may be a rigid sheet of laminated wood, particle board, or the like but preferably is a rectangular wooden frame having overlapping springing 29 laid across it. The substrate 28 has a shoulder 32 adjacent its lower end which rests on the upper edge of the frame back 16 in a first position of the components of the furniture 10 as illustrated in FIGS. 1 and 2. It should be noted, however, that the back section 24 could be allowed to rest on the floor and merely lean against frame back 16.

A U-shaped rod 34 has each end pivotably connected to the lower end of substrate 28. The rod 34 extends through pivots 21 connected at opposite sides of the brace 20. Rod 34 is preferably U-shaped with one leg connected to each side edge portion of the back section 24. The U-shaped rod causes both sides of section 24 to move together and therefore not bind. Between the legs of rod 34, there is position a support surface 36 which is slightly angled with respect to the horizontal and supported from below by brace 20. The purpose of support surface 36 will be made clear hereinafter.

The furniture 10 includes a seat section 38 preferably comprised of a first seat section 40 and a second seat section 42. In the first position as illustrated in FIGS. 1 and 2, seat section 40 overlies seat section 42 which rests on surface 36. Seat section 40 includes a cushion 44 juxtaposed to a rigid frame 46. Frame 46 is made from the same material as substrate 28 with springing designated 47. Frame 46 at its front end has a downwardly angled leg 50 extending across the width of the furniture 10. A covering material such as fabric or plastic overlies the leg 50 and the cushion 44. Leg 50 constitutes an apron for the furniture 10 since it does not act as a support leg in the first or chair position. See FIG. 2.

The end of the frame 46 adjacent the back portion 24 is hinged to a support leg 52. The second seat section 42 includes a cushion 56 juxtaposed to a rigid frame 54. Frame 54 is made from the same material as frame 46 with the springing designated 55. The cushion 56 is covered by a covering material 58 of fabric or plastic. The end of frame 54 adjacent the back portion 24 is also hinged to the leg 52. As shown more clearly in FIGS. 2 and 4, adjacent ends of the seat sections 40 and 42 are angled so as to mate with one another when the furniture is in a second or bed position while being generally parallel to the back section 24. It will be noted that the seat sections 40 and 42 are not hinged to each other but rather are hinged to the leg 52.

In the first position shown in FIG. 2, a spacer 22 which is attached to the substrate 54 supports the front end of the seat section 40. Substrate 54 is connected to the side frames 12 and 14 by a tubular shaft 60 which is attached to the substrate 54 adjacent to the spacer 22.

Figure 3:
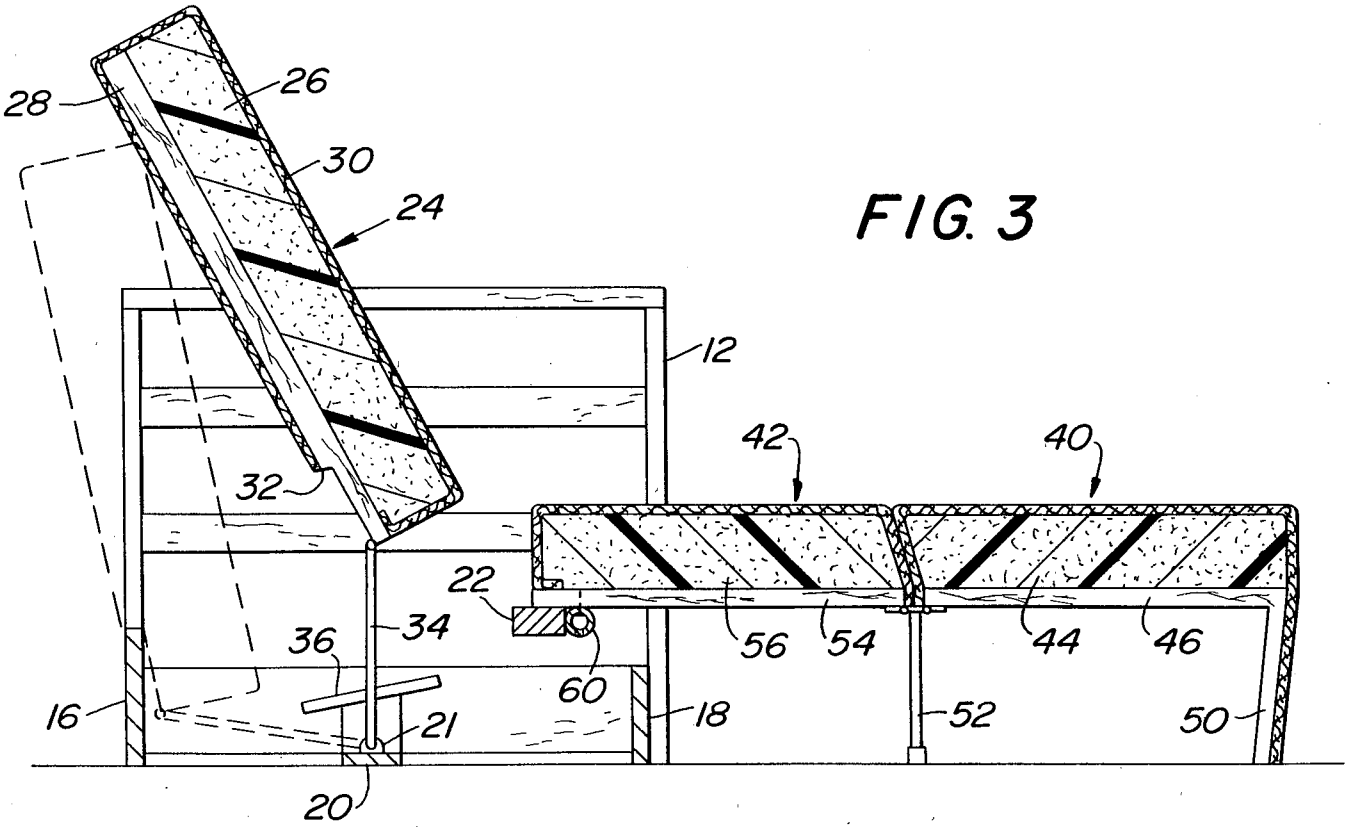
FIG. 3 is a sectional view of the furniture shown in FIG. 2 but in a partially converted position.
Figure 4:
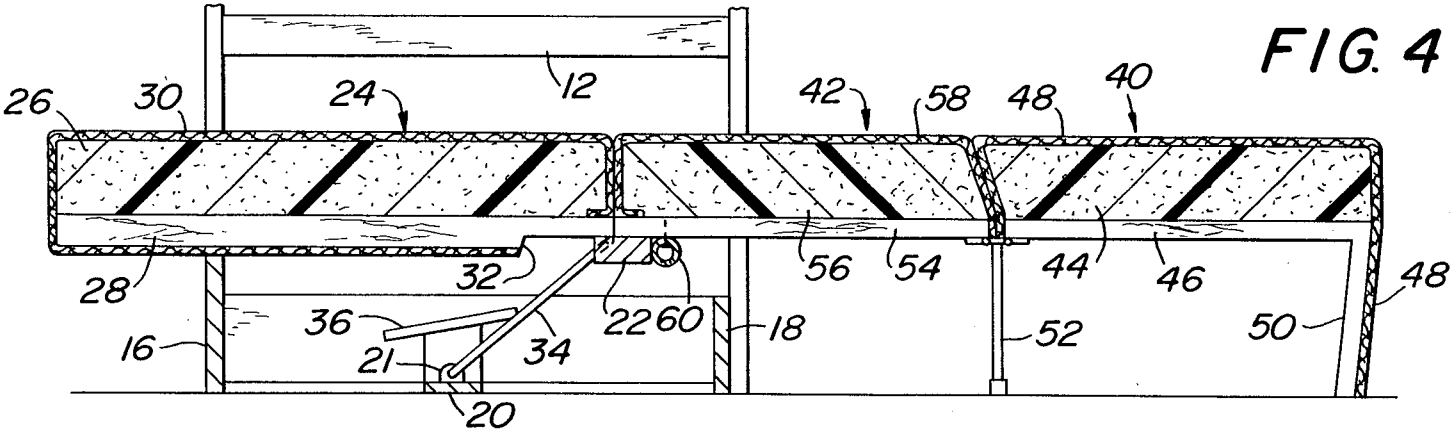
FIG. 4 is a sectional view similar to FIG. 3 but showing the furniture in the form of a bed.
Figure 5:
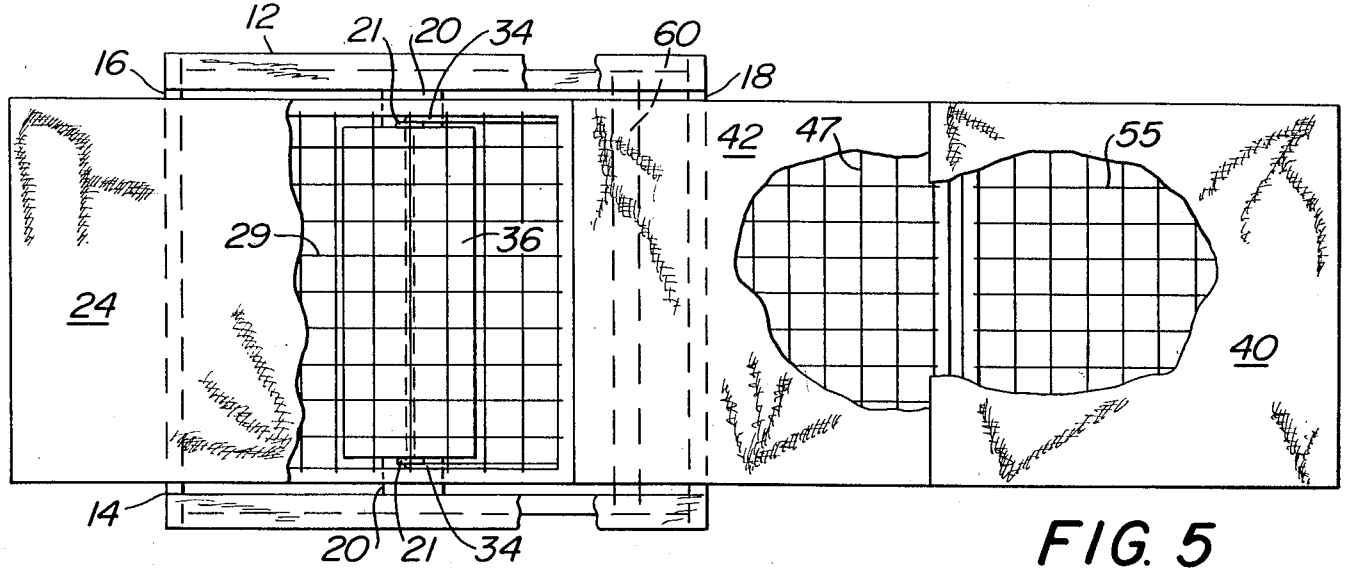
FIG. 5 is a top plan view of the furniture as shown in FIG. 4.

To convert the furniture 10 from the position shown in FIGS. 1 and 2 (first position) to the position shown in FIG. 4 (second position), the first step is to pull on the apron. If desired, the apron may have a handle attached to leg 50. This causes the seat portions 40 and 42 to move from the position shown in FIG. 2 to the position shown in FIG. 3. The seat portions are now supported by the legs 50 and 52 as well as by the tubular shaft 60. Thereafter, the back section 24 is moved from the position shown in FIG. 2 by pivoting the rod 34 through an arc greater than 90° as shown in FIG. 3. At the end of the pivotable movement of the back section 24, its lower edge is supported by the exposed surface of spacer 22 and its rear end portion is supported by the top surface of frame back 16 or could rest on the floor and lean on frame back 16. It will be noted that the seat section 24 projects beyond the frame back 16 as shown in FIG. 4. The furniture is now, as shown in FIG. 4, adapted for use as a bed. The support surface 36 is only utilized when the components are in the first position as shown in FIG. 2 for supporting the seat section 42.

The seat sections 40' and 42' are not padded. Section 46' is hinged to a front leg 64. Each of the seat sections 40' and 42' is hinged to the leg 52' in the same manner as described above.

Figure 6:
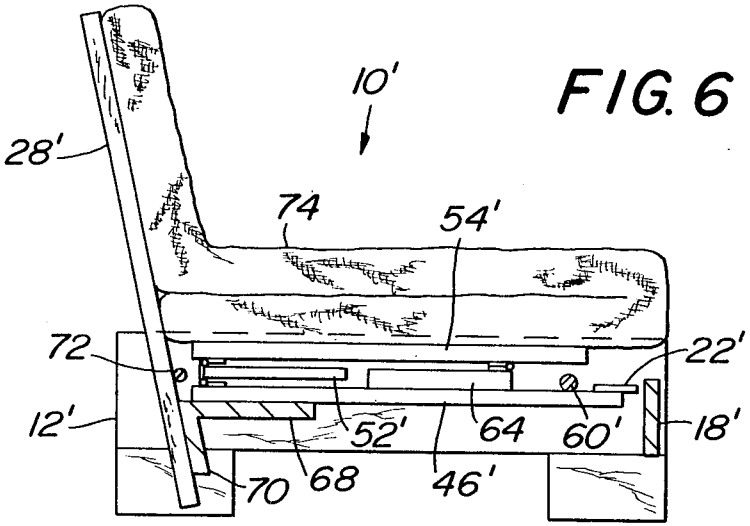
FIG. 6 is a side elevation view of furniture in accordance with another embodiment of the present invention.
Figure 7:
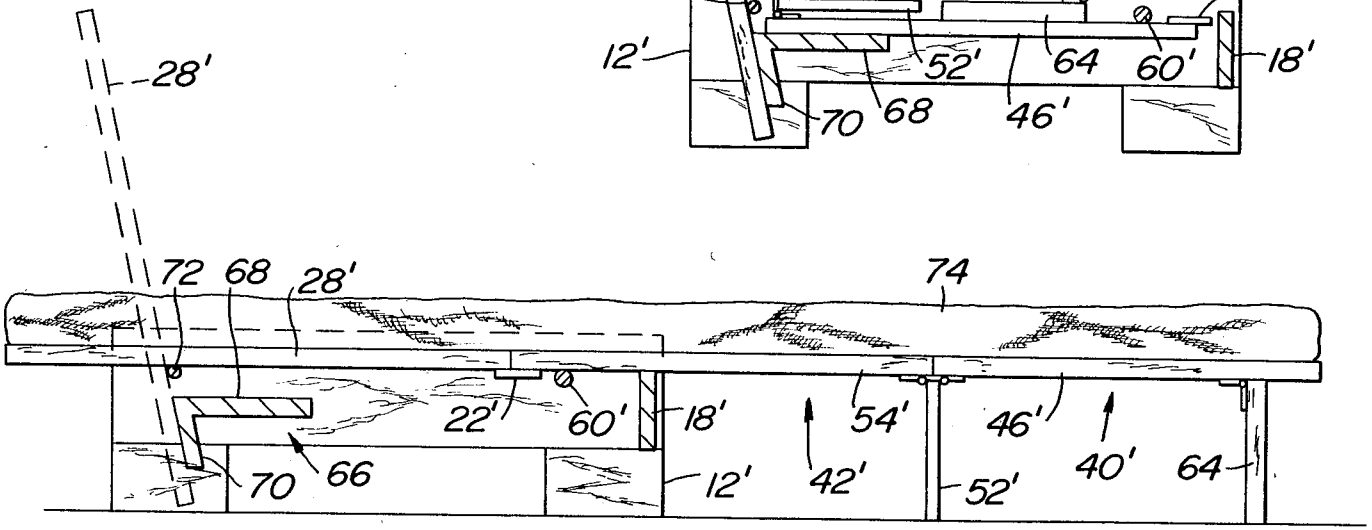
FIG. 7 is an elevation view of the furniture shown in FIG. 6 but arranged for use as a bed.

A brace 66 extends between the frame sides. Brace 66 is V-shaped with a horizontal leg 68 and an angled leg 70. The back section is defined by a substrate 28' connected to a transversely disposed shaft 72 whose ends are supported by the frame sides. In the first position as shown in FIG. 6, the substrate 28' is in contact with the angled leg 70 of the brace 66. The rear ends of the seat sections 40', 42' are supported by leg 68. In the second position of the furniture as shown in FIG. 7, the substrate 28' is supported by the shaft 72 and the spacer 22'. The rear end portion of seat section 42' is supported by the upper surface of the frame front 18'. A single cushion 74 overlies each of the seat sections. If desired, cushion 74 may be secured at its ends to the adjacent portion of the seat portions by releasable fasteners, tie strings, or the like.

The present invention may be embodied in other specific forms without departing from the spirit or essential attributes thereof and, accordingly, reference should be made to the appended claims, rather than to the foregoing specification, as indicating the scope of the invention.

I claim:

1. In a convertible seating unit which converts from a seating configuration to a sleeper configuration, having a seat section extendable forwardly from the unit when the unit is in a sleeper configuration, the improvement comprising:

a frame having a bottom for resting on the floor;

a back section having a bottom edge, a top edge, a back side and a front side;

abutment means on the frame which cooperate with back side of back section for preventing rearward motion of the back section when it is in a seating configuration;

a link with the first end rotatably attached at the bottom edge of the back section at a point which is below the seat sections when when the unit is in the seating configuration, and a second end rotably attached near the bottom of the frame at a location defining a radius of travel for the first end of the link to a point contiguous with the seat section when in the sleeper configuration;

support means on the frame for supporting the back side of the back section in approximately coplanar relationship with the seating section when the unit is in the sleeper configuration.

2. A convertible seating unit comprising:

a frame having a bottom for resting on the floor;

a seat section consisting of a first and second seating member each having, a top side, a bottom side, a front edge and a back edge, the back edge of said first seating member hingedly connected to the front edge of the second member;

the second seating member rotably connected to the frame near the back edge of said second member, whereby said seating members can be moved from a seating configuration in which the seat members are in folding engagement to a sleeper configuration with the top side of the seating members extending in a coplanar relationship;

a back section having a bottom edge, a top edge, a back side, and a front side;

abutment means on the frame which cooperate with back side of back section for preventing rearward motion of the back section when it is in a seating configuration;

a link with a first end rotably attached at the bottom edge of the back section at a point which is below the first seating member when the unit is in the seating configuration and a second end rotably attached at the bottom of the frame at a location on the frame defining a radius of travel for the first end of the link to a point contiguous with the back edge of the second seating member when in the sleeper configuration;

means for supporting the back section in a coplanar relationship with the seating sections when in the sleeper configuration.

3. The invention as claimed in claim 2 further comprising a support leg formed integral with the hinged connection between the first and second seating members.

4. The invention as claimed in claim 2 further comprising a downwardly depending support leg at the front end of the first seating member.

5. The invention as claimed to claim 2 wherein the means for supporting the back section include support means on the frame located at a point lower than the first seating section.

6. The invention as claimed in claim 5 wherein the support means on the second seating member comprises abutment means on the bottom of the second seating member extending past the back edge of the second seating member which supports the back side of the back section near its bottom edge when in the sleeper configuration.

* * * * *